US012669073B1

(12) United States Patent
Chera et al.

(10) Patent No.: US 12,669,073 B1
(45) Date of Patent: Jun. 30, 2026

(54) APPARATUS AND METHOD FOR MACHINING VALVE SEATS

(71) Applicant: Van Norman Machine India PVT LTD, Chandigarh (IN)

(72) Inventors: Ranjit (Robin) Chera, Chandigarh (IN); Sandeep Chera, Chandigarh (IN)

(73) Assignee: Van Norman Machine India PVT LTD, Chandigarh (IN)

( * ) Notice: Subject to any disclaimer, the term of this patent is extended or adjusted under 35 U.S.C. 154(b) by 0 days.

(21) Appl. No.: 18/617,693

(22) Filed: Mar. 27, 2024

(51) Int. Cl.
*F01L 3/20* (2006.01)

(52) U.S. Cl.
CPC ..... *F01L 3/20* (2013.01); *F01L 2303/00* (2020.05)

(58) Field of Classification Search
CPC ..... F01L 3/20; F01L 2303/00
See application file for complete search history.

(56) References Cited

U.S. PATENT DOCUMENTS 5,613,809 A * 3/1997 Harmand ..... B23Q 1/5456 451/430
6,086,293 A * 7/2000 Harmand ..... F01B 1/12 408/82

OTHER PUBLICATIONS https://www.youtube.com/watch?v=zLZDcTvmhyo (Year: 2024).*

* cited by examiner

*Primary Examiner* — Moshe Wilensky
(74) *Attorney, Agent, or Firm* — Riyon Rae Harding

(57) ABSTRACT

An apparatus and a method for machining valve seats in a cylinder head of an internal combustion (IC) engine are disclosed. The apparatus includes a spindle and a tool for machining said valve seats utilizing an automated cycle. The apparatus switches operation from the automated cycle to a manual mode upon detecting an irregularity in machining of the valve seat, for example. The apparatus allows an operator to adjust the spindle, the tool or the parameters in the manual mode. The apparatus switches the operation from the manual mode to the automated cycle based on the spindle, the tool or the parameters adjusted for machining the valve seats. The apparatus includes a rotary encoder configured to capture accurate position of the spindle, the tool, and rotation direction of the tool and provide feedback to the controller for optimizing the machining of the valve seats.

11 Claims, 11 Drawing Sheets

APPARATUS AND METHOD FOR MACHINING VALVE SEATS

CROSS-REFERENCE TO RELATED APPLICATION

This application is based upon and claims priority from, application No. 202411006583, filed on 31 Jan. 2024 the entireties of both of which are incorporated herein by reference for all purposes.

TECHNICAL FIELD

The present disclosure relates to valve seats, and in particular, relates to an apparatus for machining valve seats in an engine cylinder head of an internal combustion (IC) engine.

DESCRIPTION OF THE RELATED ART

It is known that valve seats are critical components in an internal combustion (IC) engine for its performance and longevity. The valve seats position in a cylinder head of the IC engine and provide a sealing surface for intake and exhaust valves in the IC engine. Typically, a valve seat boring machine or valve seat cutting machine is used for precision cutting or machining of the valve seats. The valve seat cutting machine is used to create or recondition the valve seats by removing material from the seat to achieve the desired depth. The valve seat cutting machine is operated either manually or automatically. In manual machine, the operator has direct control over the cutting process. The operator sets the parameters initially and controls the depth and finish cut of the valve seat. In automatic machines, motors and mechanisms are equipped to automate the cutting process. The operator sets the parameters initially and the machine carries out the cutting operation without constant manual intervention.

Several valve seat cutting machines have been disclosed in the past for machining valve seats. One such example is disclosed in a United States Granted U.S. Pat. No. 5,613,809, entitled "Apparatus and method for machining valve seats in an engine cylinder head" ("the '809 Patent"). The '809 Patent discloses a valve seat and guide machine comprising a base structure on which is pivotally supported a pantograph having a major arm on which is mounted a drive motor and minor arm which moves slidably with respect to the major arm. Pivotally attached to each arm of the pantograph is a head portion with a support frame which retains a spherical head and a plurality of sphere seats for supporting the spherical head so that it can pivot around its centerpoint at the center of the sphere. A stepper motor is disposed at the top of the spherical head and a spindle disposed with the spherical head retains a cutting bit and a pilot which extend from the bottom of the spherical head. Small z-axis displacement and spindle feed/retraction along the z-(vertical) axis is provided by the stepper motor. The drive motor rotates a transmission linkage which, in turn, rotates the spindle using cone-shaped pinions to cause the cutting bit, typically carbide, to cut the valve seat. Small x,y displacements are enabled by moving the entire spherical housing and its supporting sphere seats with respect to the support frame. The pantograph swings up and down on the base to provide large z-axis displacement to remove the spindle from the cutting position and to provide clearance for movement to another machine site. A system controller receives feedback from system monitors to control spindle rotations and feed/retraction.

Another example is disclosed in a United States Granted U.S. Pat. No. 6,086,293, entitled "Cutting tool for machining valve seats" ("the '293 Patent"). The '293 Patent discloses a cutting tool for machining valve seats comprises a driving system, a machining head, a pilot, a depth gauge, and a system controller. The driving system provides rotational movement and vertical movement for the machining head which is controlled by the system controller. The machining head further comprises a pinion feed driving assembly and a universal cutting blade. The pinion feed driving assembly causes the cutting radius of the cutting tool to decrease as the machining head rotates. The pilot is attached to the bottom of the machining head to provide a means for centering the cutting tool. The depth gauge is disposed on the driving system and is electrically connected to the system controller. The depth gauge measures the distance between a valve seat and the cutting blade. The system controller includes memory and programming for controlling the operation of the cutting tool. An operator can input the parameters that define the geometry of the valve seat profile. These parameters are used by the system controller to determine the rotational speed and the vertical feed of the machine spindle. The method for machining valve seats comprises four steps. First, a cylinder head is secured beneath the cutting tool and a valve seat is centered using the fixed pilot of the cutting tool. Second, the vertical feed rate of the machine spindle, the length of the vertical displacement of the spindle to machine the segment, and the number of rotations needed to machine a segment of the valve seat profile are calculated by the system controller from input parameters of the valve seat profile. Third, the system controller adjusts the vertical feed rate to cut each segment according to the desired valve seat profile. Fourth, the system controller returns the cutting blade to its original position.

Although the above discussed valve seat cutting machines are useful, they have few problems. As specified above, the existing valve seat cutting machines are either fully automatic or operated manually. The manual valve seat cutting machines are susceptible to variations in cutting pressure leading to inconsistent results. Further, it is difficult to make precise adjustments when the cutting tool has to be changed to accommodate different valve seat angles, sizes in the manual valve seat cutting machines. If the operator has to change the cutting parameters, then the operator has to turn off/stop the machine in operation and secure the tool to prevent accidental movement of the tool and/or valve seat. Alternatively, the operator has to manually make any adjustments, which is time-consuming. In other words, the manual intervention involves not only stopping the machine but also the necessity to restart and readjust the settings of the tool or tool holder.

The automatic valve seat cutting machines are designed to automate the process of cutting the valve seats. If there is any issue during the cutting operation, then it is not possible to identify and make adjustments to correct the settings or changes to the operational parameters. As a result, the valve seats may have improper shape and dimensions leading to poor sealing, reduced compression, and overall engine inefficiency. Further, the automatic valve seat cutting machines may leave chatter marks caused by tool vibration, valve seat runout or incorrect cutting speed, etc. It is not possible to obviate the issue of the chatter marks while the automated cycle is on. Further, there is no control on machining of the valve seat and speed cycle once the automated cycle starts.

In addition, in fully automatic mode, the valve seat cutting machine stops completely if manually intervened by pressing an emergency stop.

Therefore, there is a need for providing an improved apparatus for machining valve seats in an engine cylinder head in an auto cycle mode, the apparatus that provides control to avoid the issues that arise while operating in an automated cycle and/or manual mode.

SUMMARY

It is an object of the present invention to provide an apparatus for machining valve seats in a cylinder head of an internal combustion (IC) engine in a combination of both automatic and manual modes and that avoids the drawback of known fully automatic or fully manual valve seat cutting machines.

It is another object of the present invention to provide an apparatus capable of switching the operation between an automated cycle (auto cycle) and a manual mode.

It is another object of the present invention to provide an apparatus that is capable of interrupting an automated cycle and adjusting a tool or other parameters causing an irregularity in machining of the valve seat.

In order to achieve one or more objects, the present invention provides an apparatus for machining valve seats in a cylinder head of an internal combustion (IC) engine. The apparatus includes a spindle and a tool for machining said valve seats utilizing an automated cycle. Further, the apparatus includes a rotary encoder. The apparatus switches operation from the automated cycle to a manual mode upon detecting an irregularity in machining of the valve seat. The irregularity in machining of the valve seats includes improper feed, depth, chatter, improper cutting, rough cutting (i.e., cutting with very rough finish), burnishing (folding rather cutting), etc. The rotary encoder captures accurate position of the tool, spindle and a workpiece including, but not limited to, determining the rotational speed of the spindle and/or the tool, direction of rotation of the tool. In the manual mode, the apparatus allows an operator to adjust the spindle, the tool or the parameters in the manual mode. Here, the operator uses a hand wheel or a steering wheel (or steering hand wheel) for manual control and adjustment of the spindle, the tool or the parameters. The hand wheel is configured to operate in conjunction with the rotary encoder to capture the accurate position of the tool, spindle and the workpiece. Here, the rotary encoder registers the switchover from the automated cycle to the manual mode. After adjusting the parameters, the rotary encoder provides feedback to the apparatus such as position of the tool, depth of the cut, cutting speed, etc. The apparatus switches the operation from the manual mode to the automated cycle based on the spindle, the tool or the parameters adjusted for machining the valve seats.

In one aspect, the operator sets initial parameters for the automatic cutting cycle. The parameters set include, but not limited to, seat angles, sizes, cutting depth, etc. The apparatus operates automatically to perform the cutting/machining operation based on the parameters set. At any given point of time, the apparatus pauses or enters a manual mode. Here, the apparatus prompts a command on an operation panel to switch from automated cycle to the manual mode. Switching to manual mode allows the operator to inspect the workpiece, make necessary adjustments, or manually intervene in the machining process. After making the adjustments, the apparatus switches from the manual mode to the automated cycle to resume the operation and complete the remaining machining process based on the parameters adjusted.

In one advantageous feature of the present invention, the apparatus offers to interrupt the autocycle and switches to manual in order to allow the operator to machine the valve seat, control the chatter marks, and modify the feed or speed of the tool, if needed. When compared with a typical automated cycle operation in the automatic valve seat cutting machines, it is not possible to correct or adjust the parameters while the automated cycle is being run.

In another advantageous feature of the present invention, the apparatus offers switching from an automated cycle to manual and again back to the automated cycle in order to machine the valve seats. In other words, the apparatus presents a flexible approach by combining the advantages of automation with the ability for manual control when needed. The switching between automated cycle to manual and to automated cycle is referred to as a "flexible cycle" or "flexicycle". Switching from one cycle to another seamlessly allows the user to adjust the feed rate, depth, speed of tool, valve seat runout, and other parameters while the machining is in process if and when the operator detects an irregularity in machining of the valve seats. The irregularity in machining of the valve seats caused by tool vibration, valve seat runout or incorrect cutting speed, improper feed, depth, chatter, improper cutting, rough cutting, burnishing, etc.

In another advantageous feature of the present invention, the apparatus presents a flexicycle i.e., switching from an automated cycle to manual and again back to the automated cycle, which is essential in tool machining industry. The apparatus offers a more efficient and sustainable approach to seat guide processing by allowing the operator to have control over the machining process at all times. This helps to prevent or minimize tool wastage and to manage material in a sustainability manner.

The features and advantages of the invention here will become more apparent in light of the following detailed description of selected embodiments, as illustrated in the accompanying FIGURES. As will be realized, the invention disclosed is capable of modifications in various respects, all without departing from the scope of the invention. Accordingly, the drawings and the description are to be regarded as illustrative in nature.

BRIEF DESCRIPTION OF THE DRAWINGS

The present invention will now be described in detail with reference to the drawings, which are provided as illustrative examples of the invention so as to enable those skilled in the art to practice the invention. Notably, the FIGURES and examples are not meant to limit the scope of the present invention to a single embodiment, but other embodiments are possible by way of interchange of some or all of the described or illustrated elements and, further, wherein.

DETAILED DESCRIPTION

The following detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed Apparatus. However, it will be apparent to those skilled in the art that the presently disclosed invention may be practiced without these specific details. In some instances, well-known structures and devices are shown in functional or conceptual diagram form in order to avoid obscuring the concepts of the presently disclosed Apparatus.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

Although the present invention provides a description of an apparatus, it is to be further understood that numerous changes may arise in the details of the embodiments of the Apparatus. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

Various features and embodiments of an apparatus for machining valve seats in a cylinder head of an internal combustion (IC) engine are explained in conjunction with the description of FIGUREs (FIGS. 1-12.

Figure 1A:
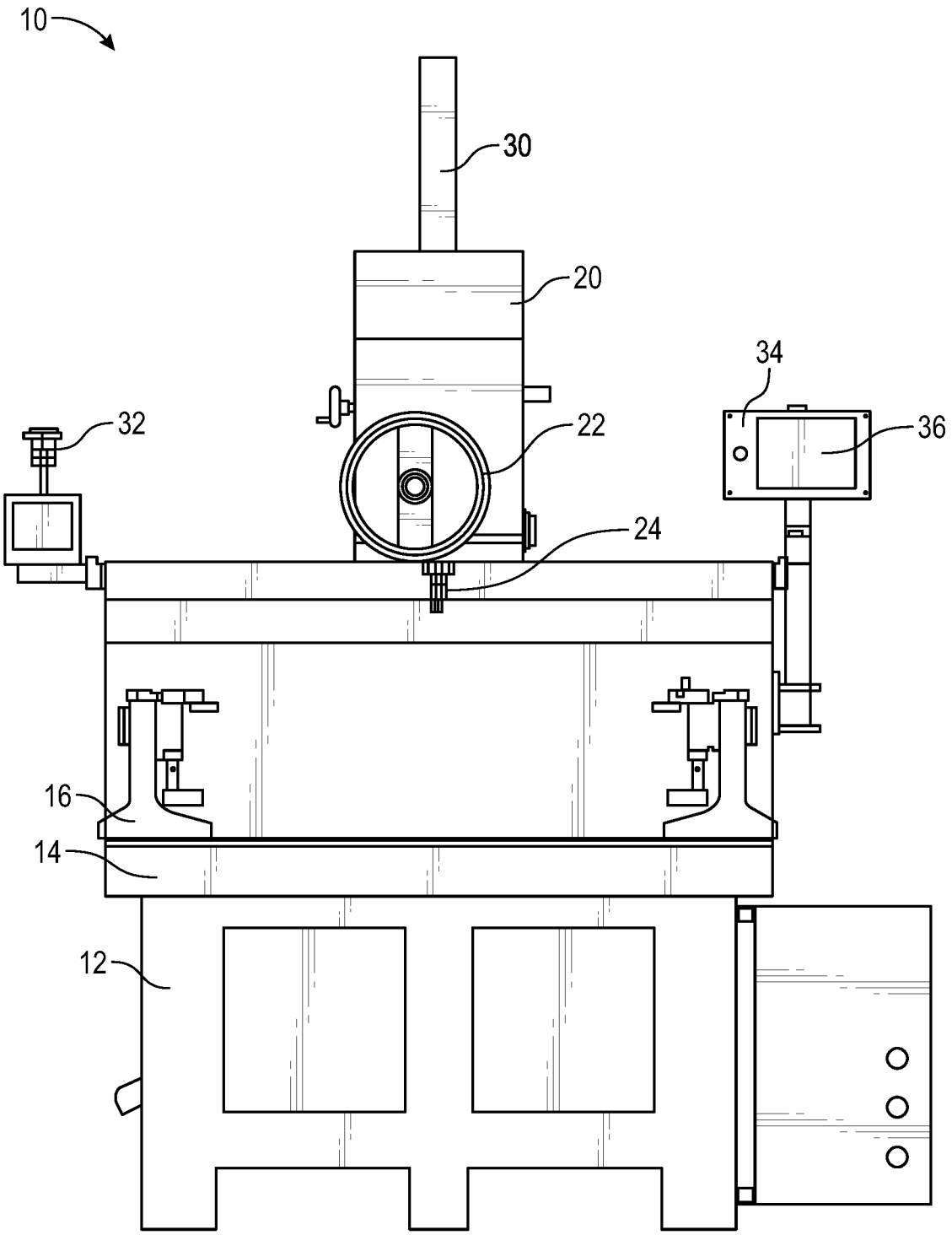
FIG. 1A and FIG. 1B illustrate a front view and a side view, respectively of an apparatus for machining valve seats in a cylinder head of an internal combustion engine, in accordance with one embodiment of the present invention.
Figure 1B:
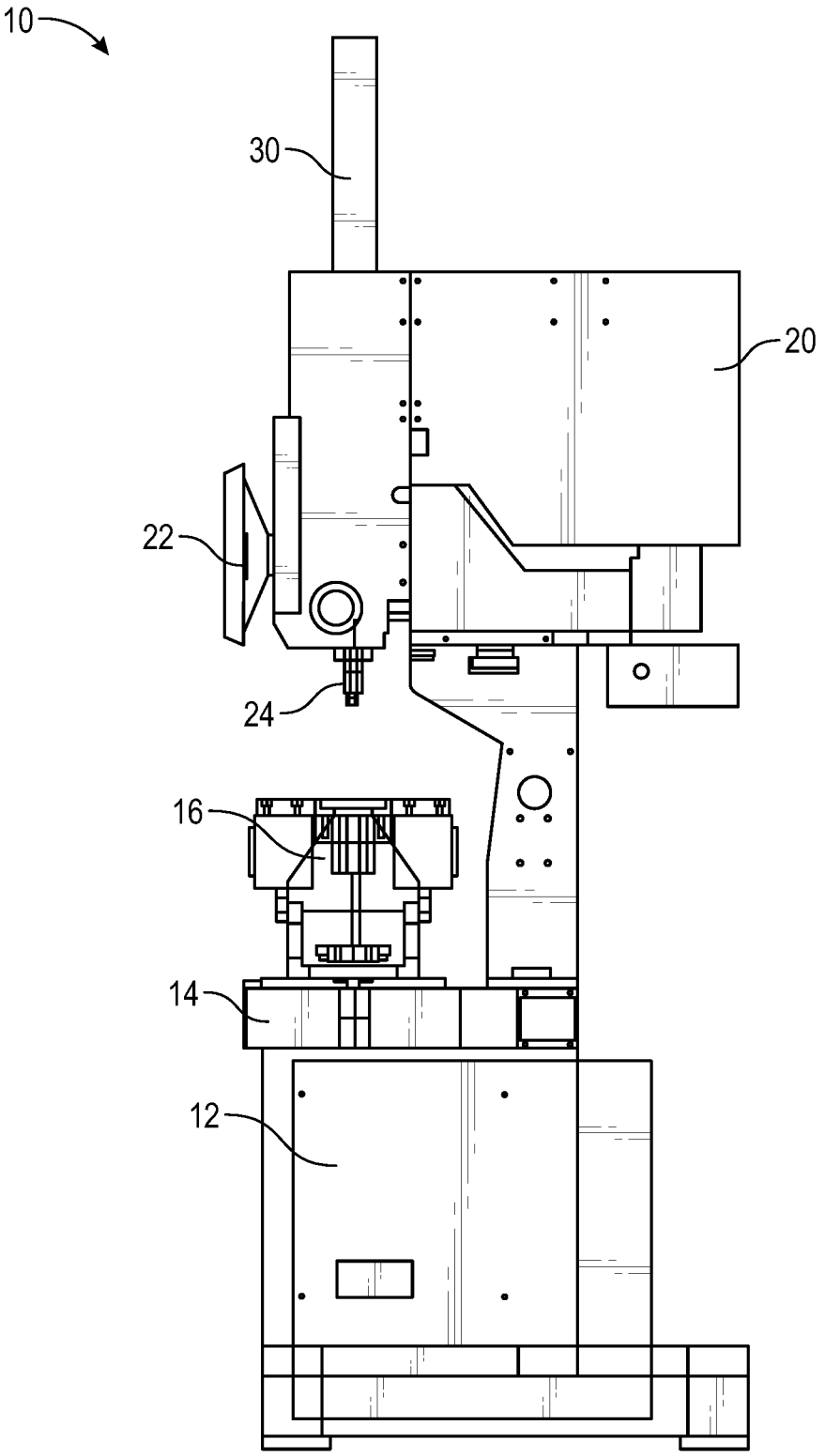
Figure 2:
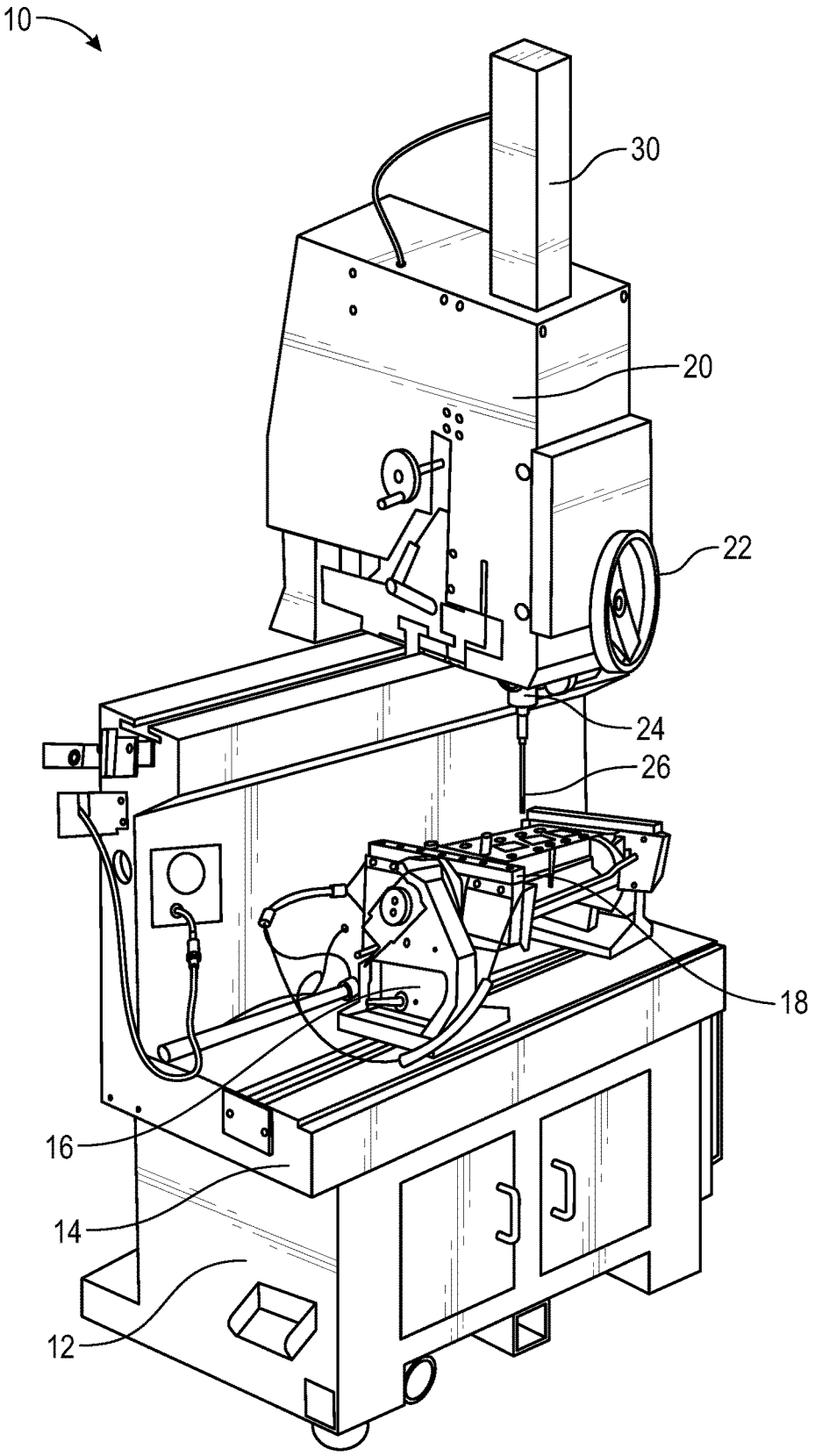
FIG. 2 illustrates a perspective view of the apparatus holding the cylinder head, in accordance with one embodiment of the present invention.
Figure 3:
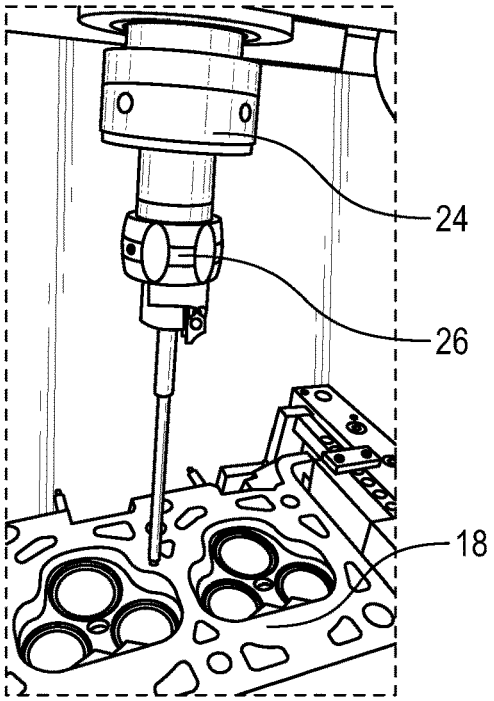
FIG. 3 and FIG. 5 illustrate the apparatus holding tools, in accordance with one embodiment of the present invention.

FIGS. 1A and 1B show a front view and a side view, respectively of an apparatus 10 for machining valve seats in a cylinder head of an internal combustion engine, in accordance with one embodiment of the present invention. Apparatus 10 includes a housing or cabinet 12 having a workbench 14. Workbench 14 is mounted on housing 12 by way of an air cushion platform which provides movement along the x, y plane. Workbench 14 includes cylinder head fixtures 16 for receiving a cylinder head 18 to be machined. FIG. 3 shows a side perspective view of apparatus 10 having cylinder head 18 placed on workbench 14 and positioned between cylinder head fixtures 16. Further, apparatus 10 includes a working head 20. Working head 20 encompasses a hand wheel 22 for adjusting manual options for fine-tuning and making adjustments on the fly.

Figure 4:
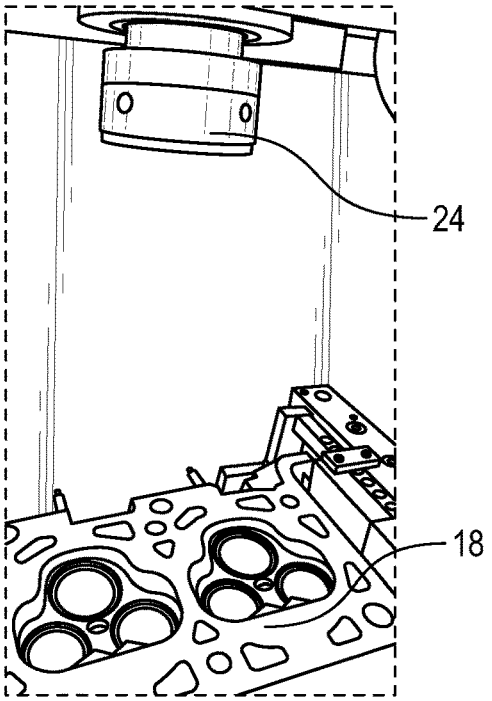
FIG. 4 illustrates the apparatus having a spindle, in accordance with one embodiment of the present invention.
Figure 5:
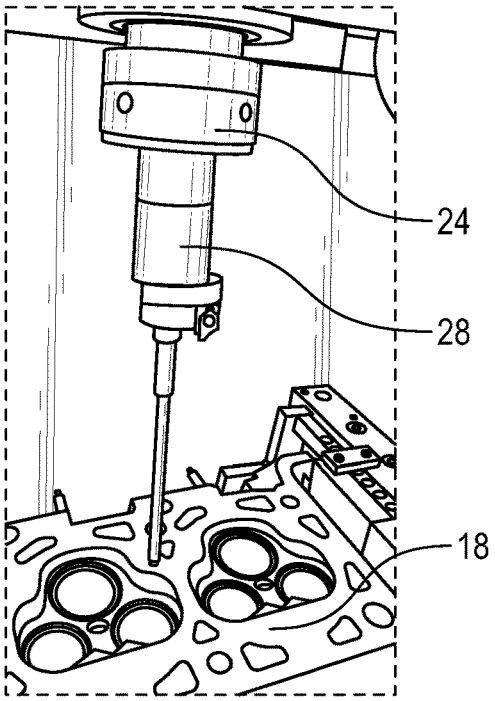
Figure 6:
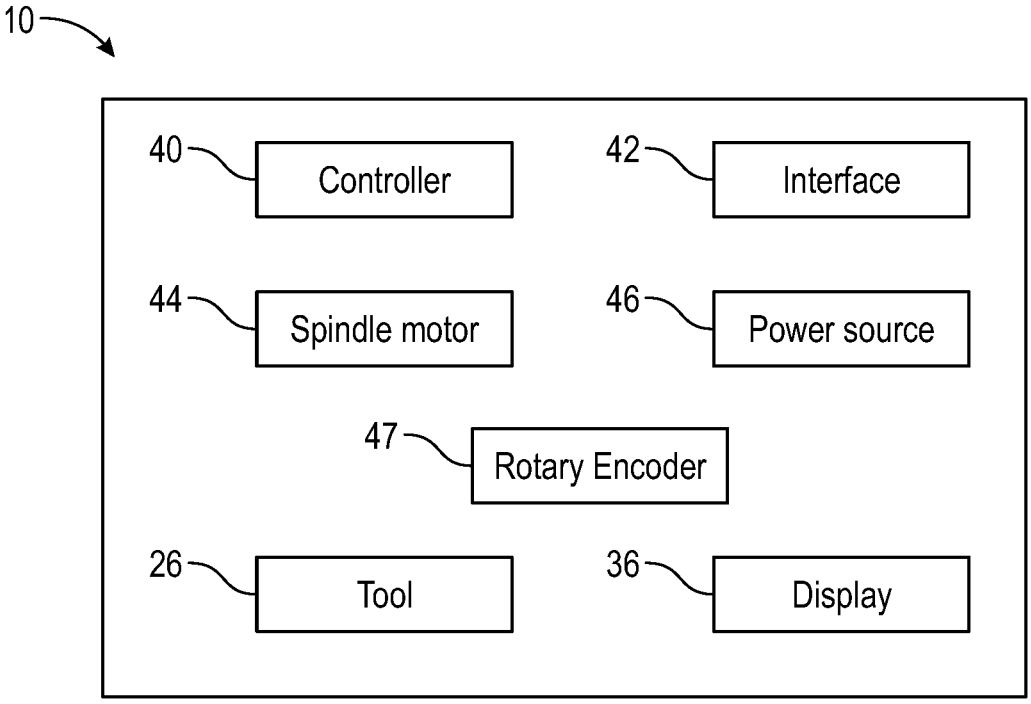
FIG. 6 shows a block diagram of apparatus 10, in accordance with one embodiment of the present invention.

Further, working head 20 includes a spindle 24 for holding a first tool or simply tool 26. FIG. 4 shows a perspective view of spindle 24 holding tool 26 such as a collared tool encompassing a sphere lock and sphere opening. In one example, tool 26 includes a valve seat cutter, guide stem, replaceable cutter insert, valve guide reamer, valve spring seat cutter, etc. FIG. 5 shows spindle 24 suspending from working head 20 without tool 26. Further, FIG. 6 shows spindle 24 holding a second tool 28. Second tool 28 includes an ULM adapter having a pilot tool. Furthermore, working head 20 includes a spindle motor housing 30 housing a spindle motor 44 (FIG. 6). Further, apparatus 10 includes an angle sensor 32 on one side and an operational panel 34 on the other side, as can be seen from FIG. 1. In one implementation, operational panel 34 includes a display 36.

FIG. 6 shows a block diagram of apparatus 10, in accordance with one embodiment of the present invention. Apparatus 10 includes a controller 40. Controller 40 includes a microcontroller configured for operating apparatus 10. In one example, controller 40 controls the operation of spindle 24 and tool 26. Apparatus 10 includes an interface 42. Interface 42 includes both manual and computerized or touchscreen interface. In the present invention, interface 42 includes a touchscreen interface allowing an operator to control the operation of apparatus 10 by touch of buttons/options provided on interface 42. Interface 42 allows the operator to navigate the options provided on display 36 or set the programmable settings to store and operate apparatus 10 based on specific machining profiles. Apparatus 10 includes a spindle motor 44 for operating spindle 24. Further, apparatus 10 includes a power source 44 such as a three-phase electrical power, a hydraulic power, a pneumatic (air) power depending on the need. In addition, apparatus 10 includes a rotary encoder 47. Rotary encoder 47 is configured to provide feedback to controller 40 of accurate position for rotating components such as spindle 24 and tool 26. The position information such as rotational speed of spindle 24 and tool 26 helps controller 40 to precisely determine the location of cutting tool 26 with respect to cylinder head 18 and control and adjust the cutting speed during the machining process. Further, rotary encoder 47 provides continuous feedback to controller 40 to adjust and/or optimize the machining process in real-time in order to enhance the precision and consistency during the machining. The feedback includes any deviations from the set parameters or speed allowing the operator to switch from the automated cycle to manual mode, or vice versa. In addition, rotary encoder 47 captures the precision achieved in a machining process and allows controller 40 to repeat the machining process to achieve overall accuracy and repeatability of the valve seat machining process.

Figure 7:
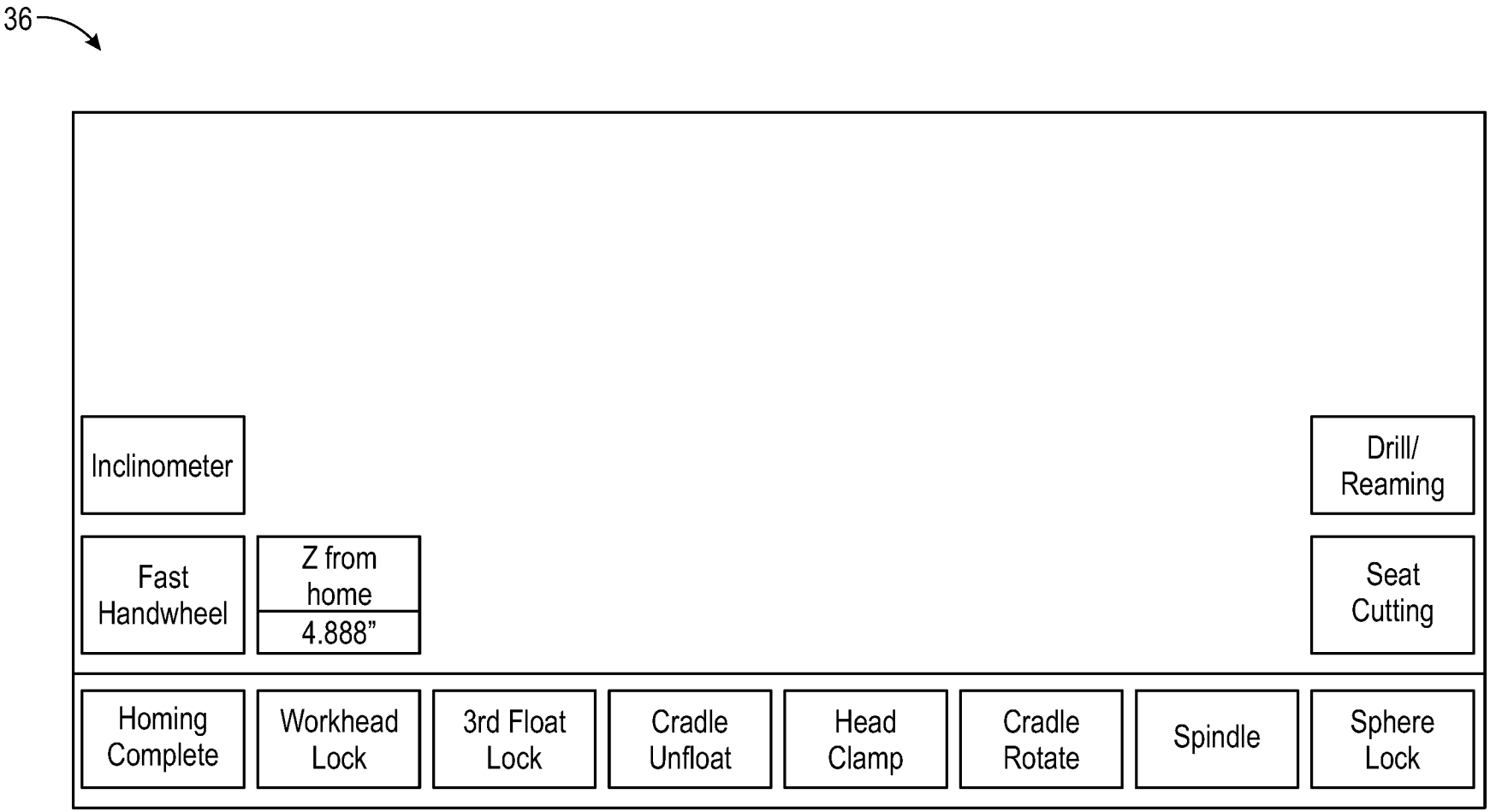
FIG. 7, FIG. 8, FIG. 9, FIG. 10 and FIG. 11 illustrate interfaces displayed on a display for controlling the operation of the apparatus, in accordance with one embodiment of the present invention.

Now referring to FIG. 7, display 36 presenting a home screen is shown, in accordance with one exemplary embodiment of the present invention. Display 36 presents a touch interface for selecting options or settings such as an inclinometer. Selecting the inclinometer presents the options to determine an angle or inclination of a valve seat relative to a reference plane. The inclinometer helps to ensure precision and accuracy in the machining process by allowing the operator to set and verify the correct angles for cutting valve seats in cylinder head 18. In other words, the inclinometer provides a way to adjust and align tool 26 to achieve the desired valve seat angle, which is crucial for optimal engine performance. Further, the operator utilizes the touch interface to determine values for hand wheel 22. In one example, hand wheel 22 is configured to operate at different speeds, say slow, medium or fast depending on the type of operation to be performed on the cylinder head 18. Similarly, the home screen presents options such as honing complete, work head lock, 3rd float lock, cradle unfloat, cylinder head clamp, cradle rotate, spindle, and sphere lock. Further, display 36 presents two additional modes such as seat cutting and drill/reaming modes.

Figure 8:
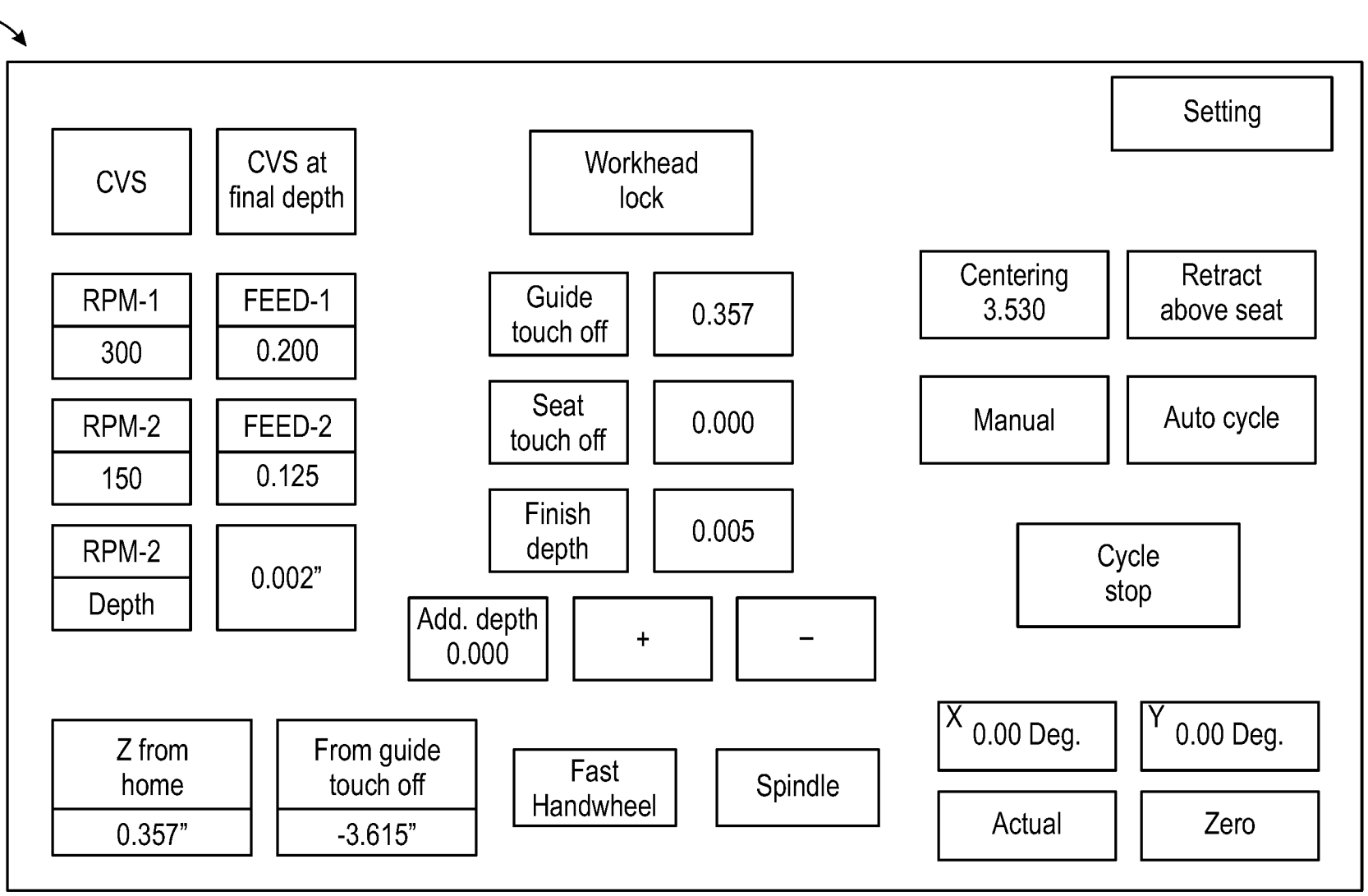
Figure 9:
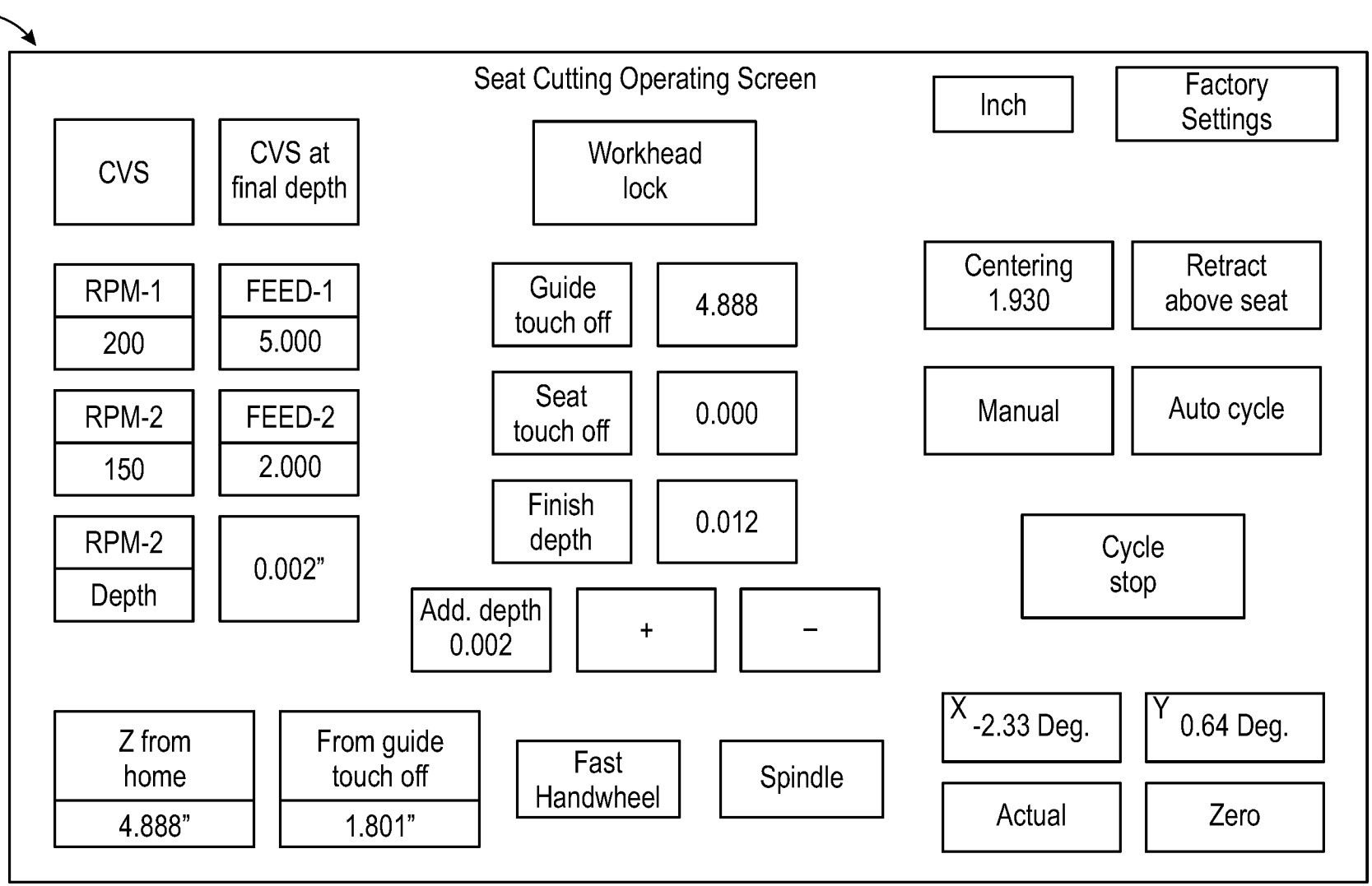
Figure 10:
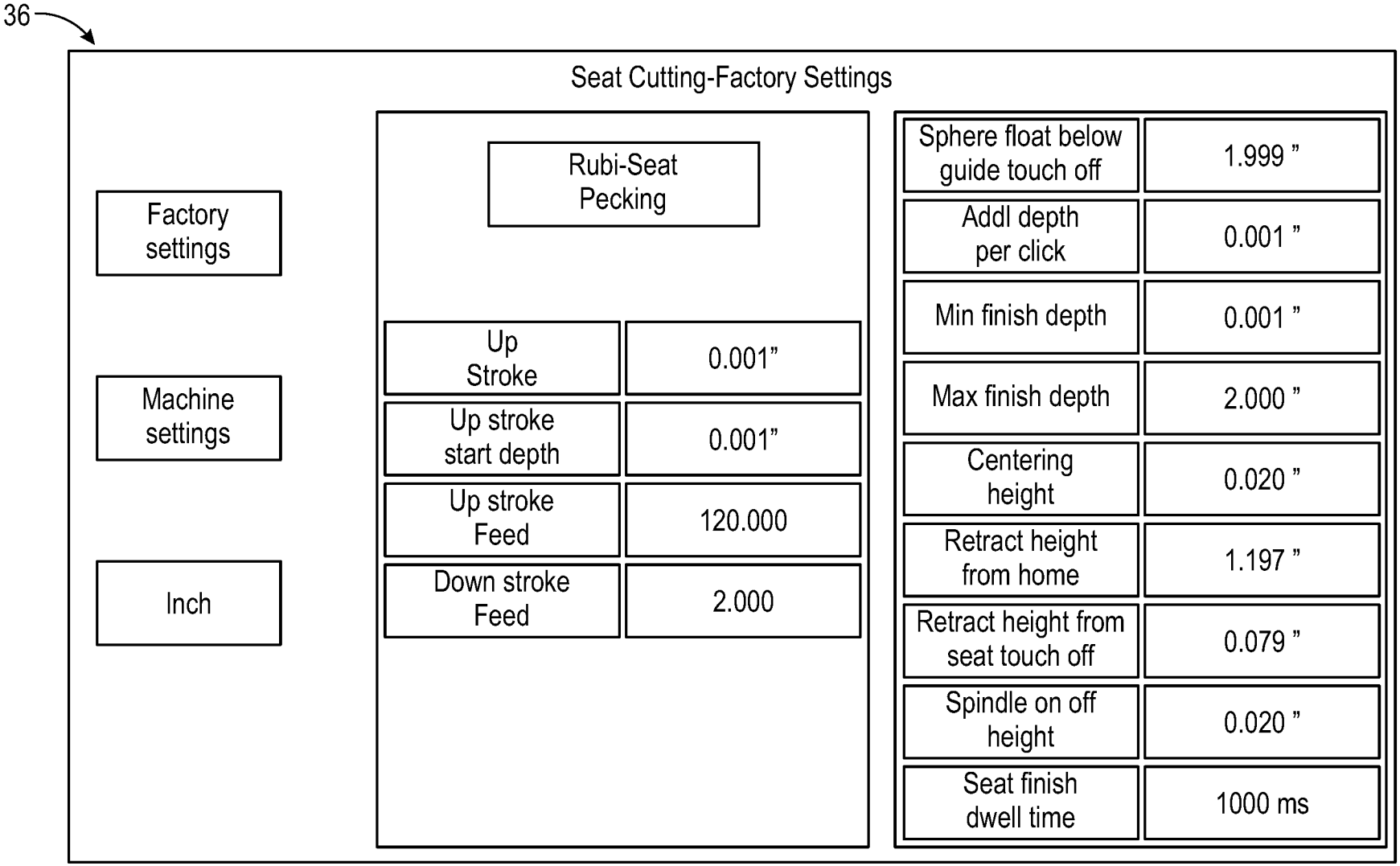
Figure 11:
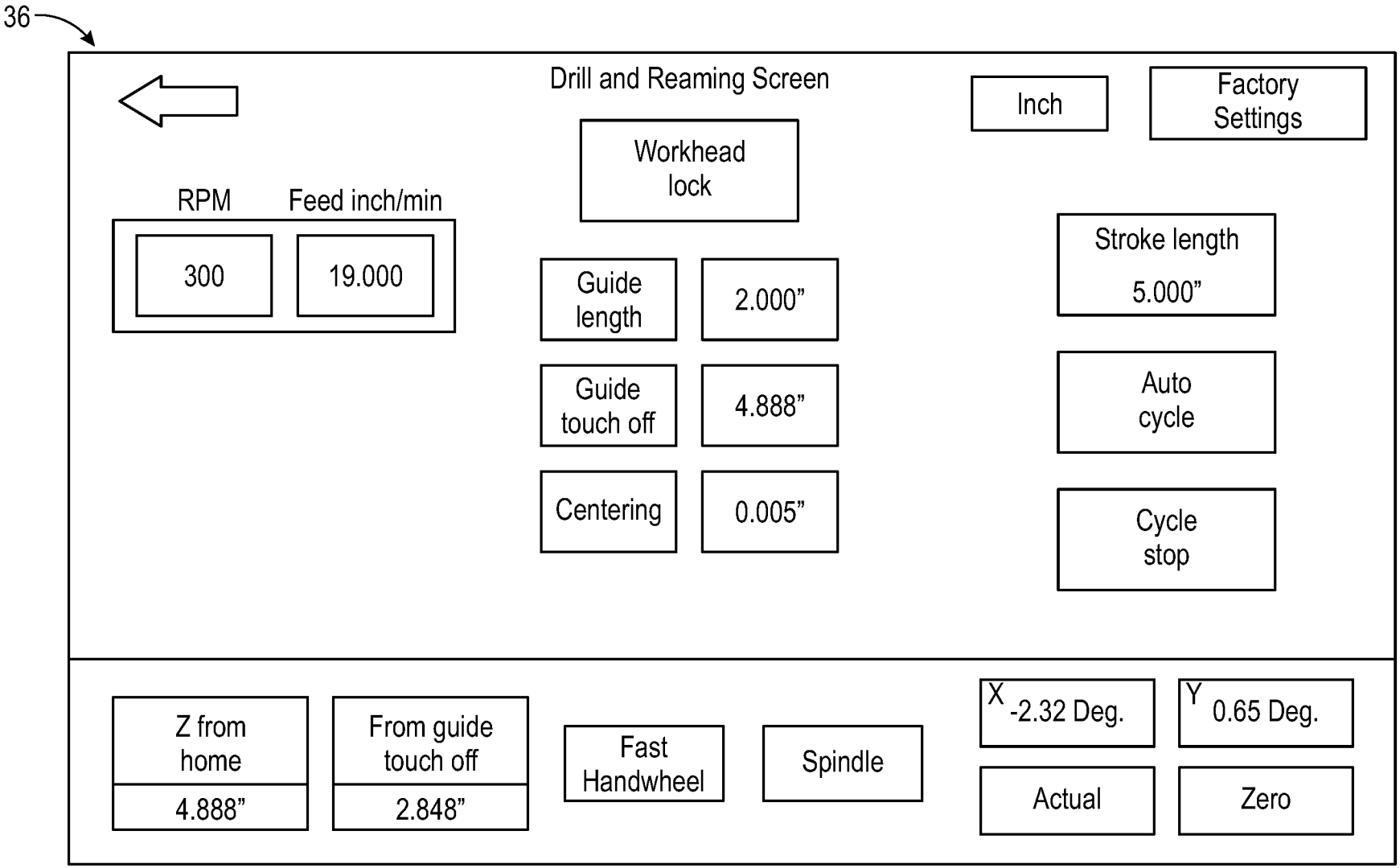
Figure 12:
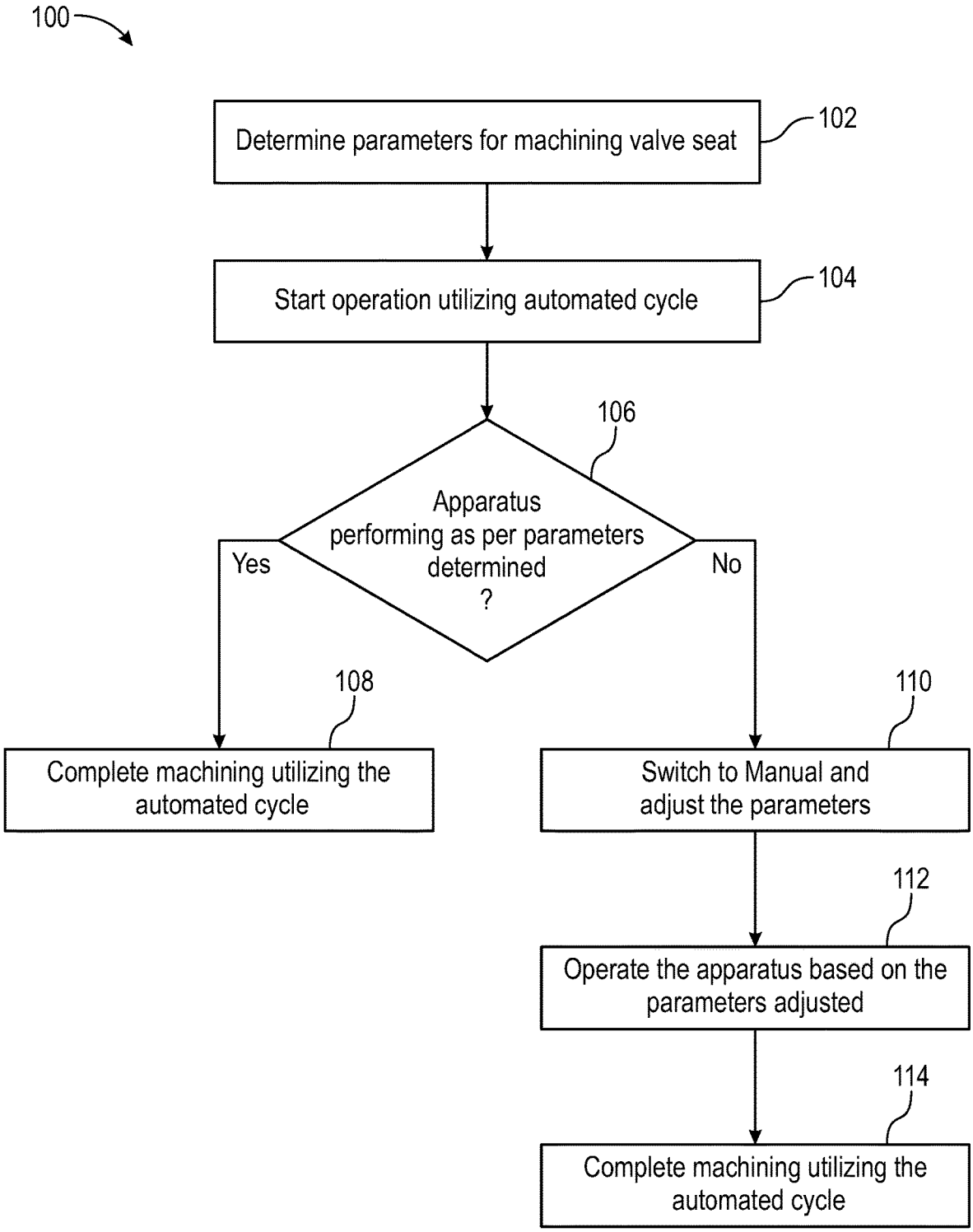
FIG. 12 illustrates a method of machining valve seats in a cylinder head of an internal combustion (IC) engine, in accordance with one embodiment of the present invention.

FIG. 8 presents display 36 showing options upon selecting seat cutting mode in the home screen presented on FIG. 7. Further, FIG. 9 shows display 36 showing different settings shown in FIG. 8. A person skilled in the art understands that the operator determines the rotations per minute (rpm) by selecting the option cvs. Further, feed rate depth and other settings are determined. FIG. 10 shows factory settings for seat cutting mode. The operator may change the settings based on the machining operation such as valve seat cutting by selecting the options presented in FIG. 9. As can be seen, display 36 presents options to select up stroke, depth of the up stroke, up stroke feed and down stroke feed. Further, the depth dimensions can be selected along with centering height and retracting height. Additionally, display 36 presents machine settings to the operator. The machine settings allow selecting maximum and minimum settings for feed/minute, rpm, slow, medium and fast feed. Further, the machine settings include settings for determining upper and lower limits for z-axis that is for retracting tool 26 above cylinder head 18 upon pressing the retract above seat option shown in FIG. 8 or FIG. 9. FIG. 11 shows display 36 showing options displayed on interface 42 when the operator selects the drill/reaming mode as shown in FIG. 9, for example. Although the present invention shows display 36 presenting a touch interface, it is possible to provide a physical button or toggle switch to select the manual mode and automated cycle operation for apparatus 10 without departing from the scope of the present invention.

In accordance with the present invention, apparatus 10 allows switching between automated cycle (auto cycle) to manual mode and back to automated cycle at the time of machining the valve seats. Now referring to FIG. 12, a method 100 of machining valve seats by switching the operation mode from auto cycle to manual and to auto cycle is explained, in accordance with one exemplary embodiment of the present subject matter. The order in which method 100 is described should not be construed as a limitation, and any number of the described method blocks can be combined in any order to implement method 100 or alternate methods. Additionally, individual blocks may be deleted from method 100 without departing from the spirit and scope of the subject matter described herein. Furthermore, method 100 can be implemented in any suitable hardware, software, firmware, or combination thereof. However, for ease of explanation, in the embodiments described below, method 100 may be implemented using the above-described apparatus 10.

Method 100 starts at step 102. At step 102, the operator determines parameters for machining valve seat in cylinder head 18. In one example, the operator determines the parameters by selecting the parameters as displayed in FIG. 9. At step 104, apparatus 10 starts the operation utilizing an automated cycle. As known, a typical operation involves the tools coming down into the valve seat, centering, operating the spindle at a defined rpm and feeding the tool to move up and down to chip away the material based on the depth and shape programmed. After machining the desired depth, the spindle is stopped and the sphere is locked and the tool is retracted. In an automated cycle, the process involves securing cylinder head 18, positioning of tool 26, automatic cutting operation involving automatic depth control, rotational speed and feed rate of tool 26, and chip management, etc. In some examples, the automated cycle involves automatic unloading of cylinder head 18.

At any given point of time, when apparatus 10 is machining cylinder head 18 utilizing the automated cycle, the operator checks whether apparatus 10 is performing as per the parameters determined, as shown in step 106. If the apparatus 10 is operating as per the parameters and machining cylinder head 18 without causing any issues in machining of the valve seat in cylinder head 18, then method 100 continues to machine the valve seat in the automated cycle, as shown in step 108.

Consider apparatus 10 needs to machine 100 microns' depth and upon reaching 75 microns' depth, tool 26 starts to vibrate. As known, vibration of tool 26 causes chatter marks which results in irregularity in depth of the valve seat in cylinder head 18. At this point, the operator determines that apparatus 10 is not machining the valve seat as intended either due to poor tool position, or tool wear, etc. As specified above, rotary encoder 47 captures accurate position of tool 26, spindle 24 and workpiece i.e., cylinder head 18 including, but not limited to, determining the rotational speed of the spindle 24 and/or tool 26, direction of rotation of tool 18. As such, rotary encoder 47 provides feedback to controller 40 for any deviations from the set parameters or speed of spindle 24 and/or tool 26. If any deviation is identified, then controller 40 prompts a notification on display 36 such that the operator can manually intervene to adjust the parameters in manual mode.

Concurrently or consecutively, the operator presses the manual option on display 36, as shown in step 110. Pressing the manual option switches the operation of apparatus 10 from the automated cycle mode to a manual mode. Here, apparatus 10 retracts tool 26 instantly to a predetermined height specified in the settings prior to the operation. A person skilled in the art understands sudden switching of the operation cycle of apparatus 10 from the automated cycle to the manual mode does not result in change in machining of valve seat as tool 26 retracts and does not come in contact with the valve seat.

Once the manual mode is activated, the operator uses hand wheel or steering wheel 22 for manual control and adjustment of various parameters. At this time, rotary encoder 47 registers the switchover from the automated cycle to the manual mode and captures accurate position of tool 26, spindle 24 and workpiece 28 including, but not limited to, determining the rotational speed of the spindle and/or the tool, direction of rotation of the tool. After switching to manual mode, the operator adjusts the parameters. In one example, the operator adjusts the vertical movement of cutting tool 26 in order to control the machining into the valve seat. In one example, the operator adjusts the lateral movement of cutting tool 26 for controlling lateral movement of cutting tool 26. In one example, the operator manually rotates or positions spindle 24 in order to align tool 26. In one example, the operator manually adjusts the position of tool 24 such as angle of cutting (in case of an offset). In one example, the operator may identify chatter marks due to harder or softer tool or softer valve seat. In this instance, the operator switches from the automated cycle to the manual mode to adjust the tool angle, or tool depth or feed to avoid the chatter marks from forming on the valve seat.

In the present invention, switching of the operation from the automated cycle to the manual mode creates an interruption cycle for adjusting tool 26, cylindrical head 18 or any other component involved in machining of valve seat. Here, the operator adjusts the tool, spindle, cylinder head and feed rate or speed of tool 26, as shown at step 112. In other words, apparatus 10 provides flexibility to the operator to change the original parameters when the operation is in manual. After adjusting the parameters, rotary encoder 47 provides feedback to controller 40 of accurate position for rotating components such as spindle 24 and tool 26. Additionally, rotary encoder 47 provides feedback on any deviations from the originally set parameters or speed allowing the operator to make further adjustments. Subsequently, the operator presses the auto cycle on display 36. Pressing the auto cycle switches the operation of apparatus 10 from the manual mode to the automated cycle, as shown in step 114. After switching the operation to the automated cycle, apparatus 10 resumes the operation and complete the remaining machining process on cylinder head 18 based on the parameters adjusted. During the automated cycle, rotary encoder 47 provides continuous feedback to controller 40 to adjust and/or optimize the machining process in real-time in order to enhance the precision and consistency during the machining. This way, apparatus 10 allows the operator to have a flexibility to switch from the automated cycle to the manual mode and back to the automated cycle. In one example, the switch from the automated cycle to manual to the automated cycle is termed as "flexicycle", indicating the flexibility to switch from automated cycle to manual and back to automated cycle.

Although the above example is explained considering an irregular depth, a person skilled in the art understands that the apparatus can be switched from the automated cycle to the manual mode upon detecting irregularity in machining such as improper feed, depth, chatter, not cutting properly, cutting with very rough finish, burnishing (folding rather cutting), and other related irregularities without departing from the scope of the present invention.

The presently disclosed apparatus provides several advantages over the prior art. The apparatus offers a flexible cycle or flexicycle i.e., switching from an automated cycle to manual and to the automated cycle in order to machine the valve seats. This allows the user to adjust the feed rate, depth, speed of tool, valve seat runout (deviation or wobbling of the valve seat from its intended axis of rotation due to worn or damaged tool holder, loose tool holder or collet, misalignment of machine components, improper installation, chips or debris, etc.), and other parameters while the machining is in process. The apparatus offers to interrupt the autocycle and switch to manual in order to allow the operator to machine the valve seat, control the chatter marks, and modify the feed or speed of the tool, if needed. The switchover is performed in a seamless manner with a touch of a button on the operational panel (display).

A person skilled in the art appreciates that the apparatus can come in a variety of shapes and sizes depending on the need. Further, many changes in the design and placement of components may take place without deviating from the scope of the presently disclosed apparatus.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. An apparatus for machining valve seats in a cylinder head of an internal combustion (IC) engine, said apparatus comprising:

a housing having cylinder head fixtures for receiving said cylinder head;

a working head positioned above said housing, wherein said working head comprises a spindle and a tool, and wherein said tool is configured to machine said valve seats in said cylinder head;

a hand wheel for manually operating said spindle and said tool;

an operational panel; and a controller communicatively connected to said operational panel, wherein said controller controls said spindle and said tool, wherein said controller operates spindle and said tool utilizing an automated cycle for machining said valve seats, wherein said controller switches the operation of said apparatus from said automated cycle to a manual mode upon detecting an irregularity in machining of said valve seats, wherein said controller facilitates adjusting said spindle, said tool or said parameters in said manual mode, and wherein said controller switches the operation of said apparatus from said manual mode to said automated cycle based on said spindle, said tool, or said parameters adjusted for machining said valve seats.

2. The apparatus of claim 1, further comprises a rotary encoder, wherein said rotary encoder is configured to capture accurate position of said spindle, said tool, and rotation direction of said tool and provide feedback to said controller for optimizing the machining of said valve seats.

3. The apparatus of claim 1, wherein said controller switches the operation of said apparatus from said automated cycle to said manual mode and to said automated cycle based on instructions received from said operational panel.

4. The apparatus of claim 3, wherein said operational panel comprises a display presenting options to select said automated cycle and said manual mode.

5. The apparatus of claim 3, wherein said operational panel comprises a toggle switch for selecting said automated cycle and said manual mode.

6. The apparatus of claim 1, wherein said controller interrupts said automated cycle for switching the operation of said apparatus from said automated cycle to said manual mode.

7. The apparatus of claim 1, wherein said controller instructs the tool to retract upon switching from said automated cycle to said manual mode.

8. The apparatus of claim 7, wherein said tool retracts to a predetermined height.

9. The apparatus of claim 1, wherein said controller adjusts one of feed rate, speed of said tool, and aligning an angle of said tool.

10. The apparatus of claim 1, wherein said controller interrupts said automated cycle for switching the operation of said apparatus from said automated cycle to said manual mode for cleaning up said valve seat or adjusting valve seat runout of said valve seats.

11. The apparatus of claim 1, wherein the irregularity in machining of said valve seats comprises one of improper feed, depth, chatter, improper cutting, rough cutting, and burnishing.

* * * * *